US006408524B1

(12) United States Patent
Lai

(10) Patent No.: US 6,408,524 B1
(45) Date of Patent: Jun. 25, 2002

(54) TABLEWARE GRIP STRUCTURE WITH COMFORTABLE TOUCH FEELING

(76) Inventor: Yin-Chu Lai, No. 378, Pao-Bou Rd., Changhua (TW)

( * ) Notice: Subject to any disclaimer, the term of this patent is extended or adjusted under 35 U.S.C. 154(b) by 203 days.

(21) Appl. No.: 09/594,728

(22) Filed: Jun. 16, 2000

(51) Int. Cl.[7] ..... B25G 1/10

(52) U.S. Cl. ..... 30/324; 30/340; 16/422; 16/430; 16/DIG. 12

(58) Field of Search ..... 30/322, 324, 340; D7/653, 664; 16/110.1, 421, 422, 430, 431, 436, DIG. 12

(56) References Cited

U.S. PATENT DOCUMENTS 2,984,486 A * 5/1961 Jones ..... 16/421
3,266,081 A * 8/1966 Heim ..... 30/340
D330,481 S * 10/1992 Green ..... D7/653
5,210,925 A * 5/1993 Morgulis ..... 30/340
5,261,665 A * 11/1993 Downey ..... 473/303
5,551,323 A * 9/1996 Beere et al. ..... 16/430
5,740,586 A * 4/1998 Gomas ..... 16/430
6,070,329 A * 6/2000 Gibbs ..... 30/340

* cited by examiner

*Primary Examiner*—Hwei-Siu Payer
(74) *Attorney, Agent, or Firm*—Dennison, Schultz & Dougherty

(57) ABSTRACT

Tableware grip structure with comfortable touch feeling including a grip and a fitting body. A front end of the grip is disposed with a fitting section formed with a fitting slot at front end for fitting with a tableware. The grip is formed with multiple arch bulge sections and multiple recessed sections which are interlaced with each other. Each recessed section is formed with at least one through hole. The fitting body is correspondingly fixedly fitted on the recessed sections of the grip. The outer circumferences of the bulge sections and the fitting body together form a waved face for a user's hand to more snugly hold and more conveniently turn the grip and achieve a more comfortable touching feeling.

7 Claims, 6 Drawing Sheets

TABLEWARE GRIP STRUCTURE WITH COMFORTABLE TOUCH FEELING

BACKGROUND OF THE INVENTION

The present invention relates to a tableware grip structure with comfortable touch feeling, and more particularly to a tableware grip structure in which the grip is formed with multiple arch bulge sections and multiple recessed sections which are interlaced with each other. A fitting body is fixedly correspondingly fitted on the recessed sections of the grip, whereby the outer circumferences of the bulge sections and the fitting body together form a waved face for a user's hand to more snugly hold and more conveniently turn the grip and achieve a more comfortable touch feeling. The grip structure is applicable to various kinds of tableware or the like.

Numerous tableware grips have been proposed, for example, a flat tableware grip made of relatively heavy metallic material such as aluminum-zinc alloy or stainless steel. A substantially U-shaped bracket extends from or is fixed at one end of the tableware grip such as a spoon or a fork. In use of such tableware, the bracket serving as a supporting point enables the tableware to stably rest on a table face in an elevated state without touching the table face so as to ensure hygiene. However, the hard and flat tableware grip can be hardly snugly gripped by a user's hand, especially by a handicapped person who can hardly turns the grip. Therefore, a user cannot conveniently to use such tableware. Moreover, the grip is too hard for a user to comfortably hold.

SUMMARY OF THE INVENTION

It is therefore a primary object of the present invention to provide a tableware grip structure with comfortable touching feeling. The grip is formed with multiple arch bulge sections and multiple recessed sections which are interlaced with each other. A fitting body is fixedly correspondingly fitted on the recessed sections of the grip, whereby the outer circumferences of the bulge sections and the fitting body together form a waved face for a user's hand to more snugly hold and more easily turn the grip.

It is a further object of the present invention to provide the provide the above tableware grip structure in which the fitting body is made of soft material so as to achieve a more comfortable touch feeling for a user's hand.

According to the above objects, the tableware grip structure of the present invention includes a grip and a fitting body. A front end of the grip is disposed with a fitting section formed with a fitting slot at front end for fitting with a tableware. The grip is formed with multiple arch bulge sections and multiple recessed sections which are interlaced with each other. Each recessed section has at least one through hole. The fitting section is fixedly correspondingly fitted on the recessed sections of the grip. The outer circumferences of the bulge sections and the fitting body together form a waved face for a user's hand to more snugly hold and more conveniently turn the grip. In addition, the fitting body is made of soft material so that a more comfortable touch feeling is achieved for a user's hand when holding the grip.

The present invention can be best understood through the following description and accompanying drawings wherein:

DETAILED DESCRIPTION OF THE PREFERRED EMBODIMENTS

Figure 1:
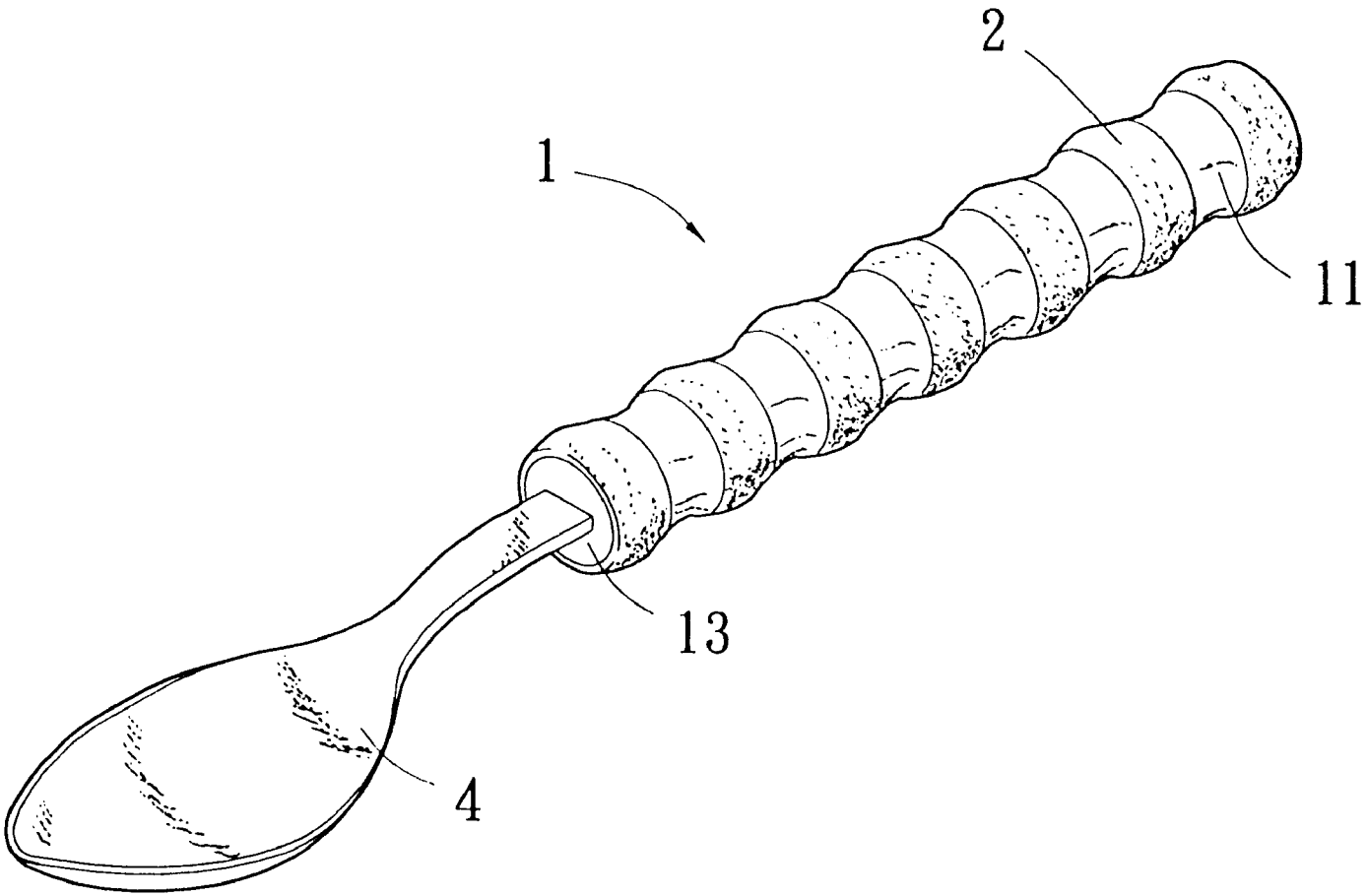
FIG. 1 is a perspective assembled view of the tableware grip structure of the present invention.
Figure 2:
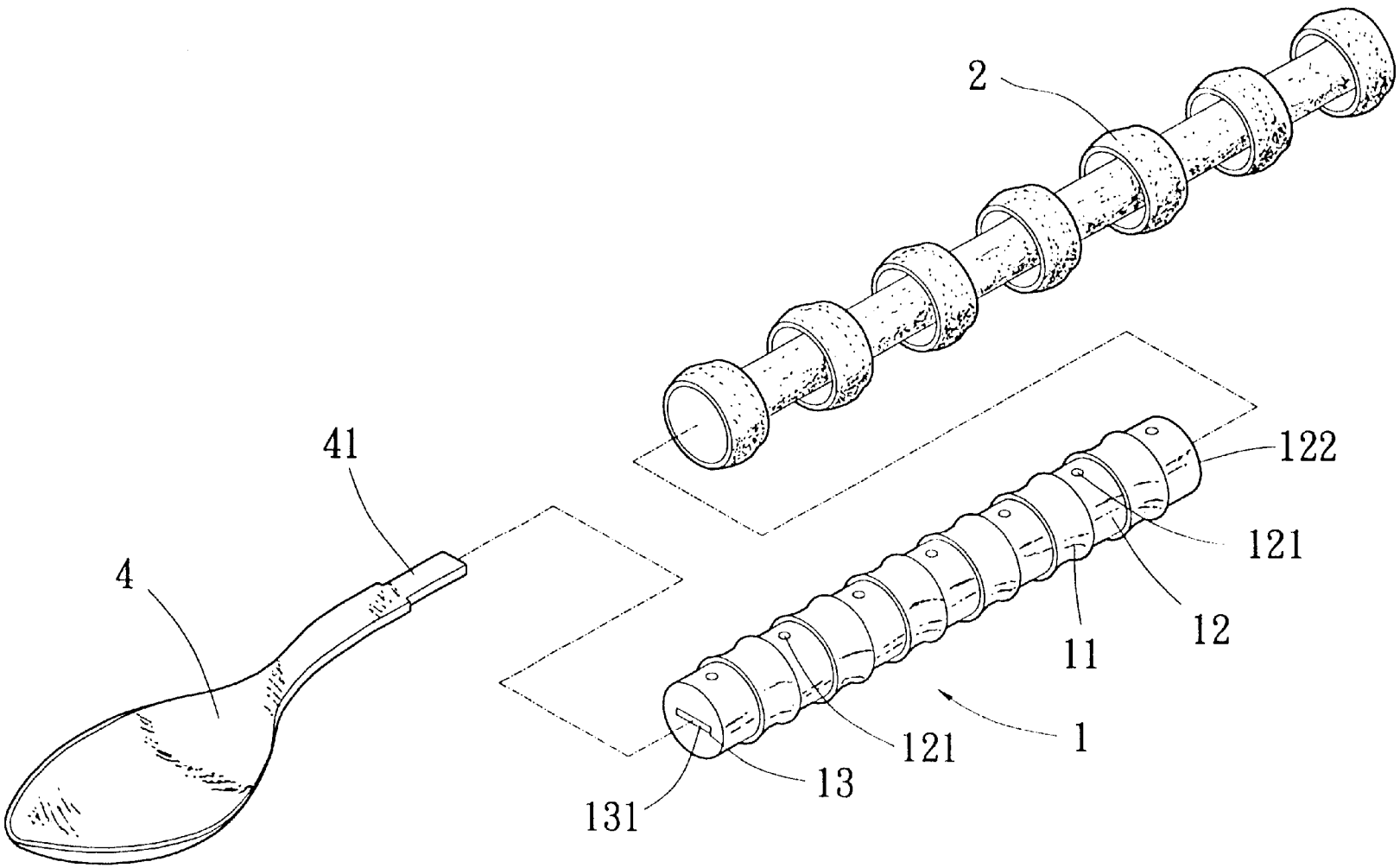
FIG. 2 is a perspective exploded view of the tableware grip structure of the present invention.

Please refer to FIGS. 1 and 2. The tableware grip structure with comfortable touch feeling according to the present invention includes a grip 1, a fitting body 2 and a spoon 4.

The grip 1 is made by integral inject ion molding and formed with multiple arch bulge sections 11 and multiple recessed sections 12 which are interlaced with each other. An upper and a lower portions of each recessed section 12 are respectively formed with two through holes 121. A front end of the grip 1 has a fitting section 13 formed with a fitting slot 131 at front end. A rear end of the grip 1 is formed with an opening 122.

A rear end of the spoon 4 is formed with a projecting section 41 fitted in the fitting slot 131 of the fitting section 13 of the grip 1. The fitting body 2 is formed in such a manner that the grip 1 is placed in a mold and a soft material is fitted into the opening 122 of the rear end of the grip 1. The soft material then flows out from the respective through holes 121 of the grip 1 to solidify and form the fitting body 2 fixedly combined with the grip 1.

The fitting body 2 is fixedly snugly fitted on the recessed section 12 of the grip 1. The fitting body 2 is formed with a clamping section 21 on upper and lower sides of the fitting section 13 of the grip 1 ( as shown in FIG. 3*b*). The clamping section 21 is tightly associated with the fitting section 13 of the grip 1 and the projecting section 41 of the spoon 4.

Figure 3A:
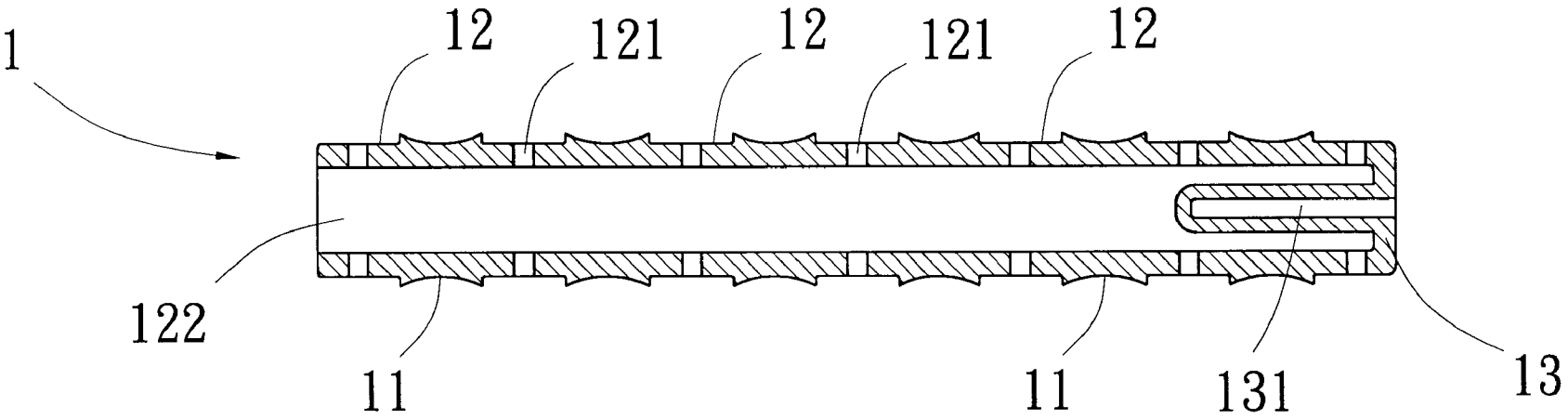
FIG. 3*a* is a sectional view of the grip of the present invention.
Figure 3B:
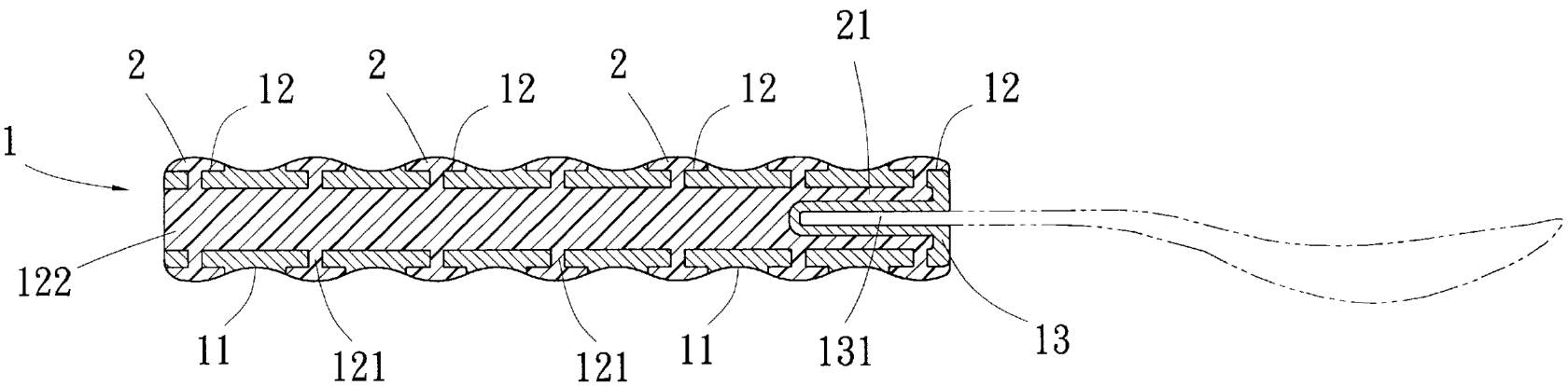
FIG. 3*b* is a sectional view showing that the fitting body is fixedly fitted around the grip of the present invention.

Referring to FIGS. 1, 3*a* and 3*b,* the fitting body 2 is fixedly snugly fitted on the recessed section 12 of the grip 1. The multiple arch bulge sections 11 and the outer circumference of the fitting body 2 fitted around the recessed sections 12 together form a waved face for the hand to easily hold the grip. Moreover, a user's hand can 360 degrees turn the arched and waved grip 1 so that a handicapped person can also conveniently hold the grip. The fitting body 1 is made of soft material so that the hand can more comfortably touch the grip. The grip 1 and the fitting body 2 can have same or different colors.

Figure 4:
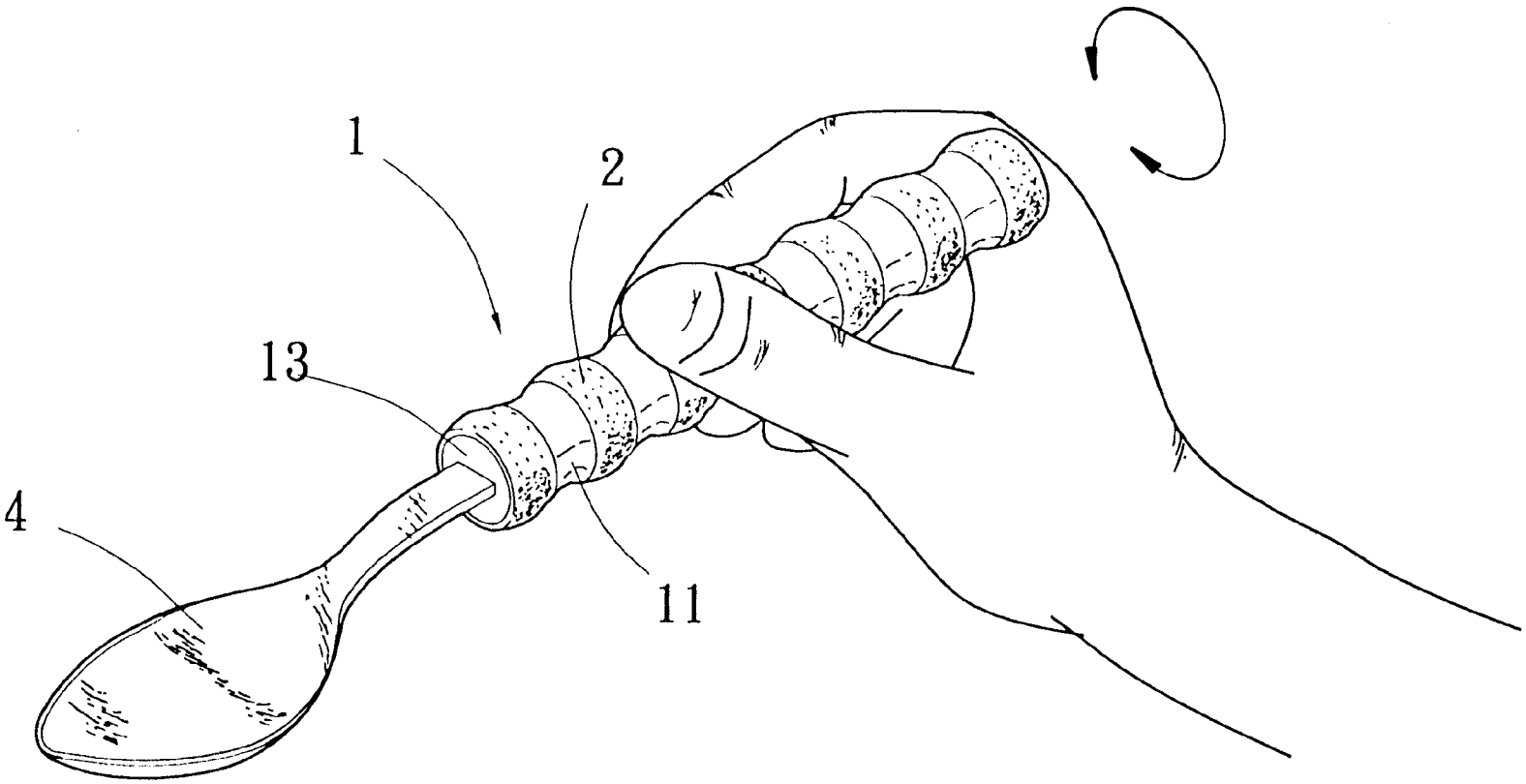
FIG. 4 is a perspective view showing that the grip structure of the present invention is applied to a spoon.

Referring to FIG. 4, in use, the fitting body 2 is fixedly fitted on the respective recessed section 12 of the grip 1 and associated with a spoon 4 fitted in the fitting section 13 of the grip 1. By means of the waved face multiple arch bulge sections 11 and the outer circumference of the fitting body 2, a user's hand is able to more easily hold and turn the grip and achieve more comfortable touching feeling.

Figure 5:
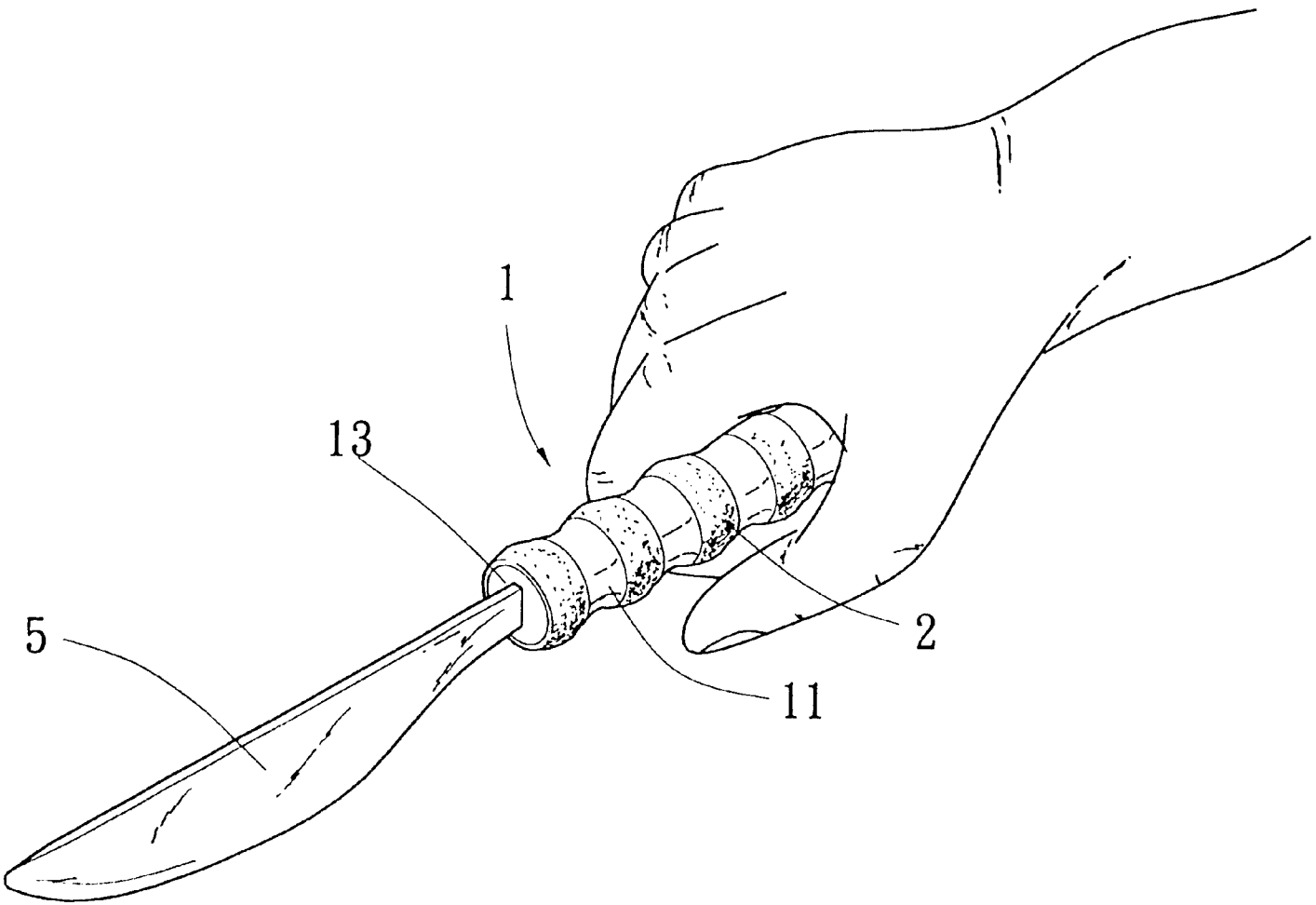
FIG. 5 is a perspective view showing that the grip structure of the present invention is applied to a dining knife.

Referring to FIG. 5, in use, a dining knife 5 or other dinnerware can be alternatively fitted with the grip 1.

According to the above arrangement, the present invention has the following advantages:

1. The grip is formed with multiple arch bulge sections and multiple recessed sections. The fitting body is fitted on the recessed sections. The bulge sections and the outer circumference of the fitting body together form a waved face for a user's hand to tightly hold grip. In addition, the user's hand can easily 360 degrees turn the grip. Therefore, even a handicapped person can conveniently control and use the tableware.

2. The fitting body is made of soft material so that the user's hand will have a more comfortable touching feeling.

The above embodiments are only used to illustrate the present invention, not intended to limit the scope thereof. Many modifications of the above embodiments can be made without departing from the spirit of the present invention.

What is claimed is:

1. Tableware grip structure with comfortable touch feeling comprising a grip and a fitting body, a front end of the grip being disposed with a fitting section formed with a fitting slot at front end for fitting with a tableware, said tableware grip structure being characterized in that the grip is formed with multiple arch bulge sections and multiple recessed sections which are interlaced with each other, each recessed section being formed with at least one through hole, the fitting body being correspondingly fixedly fitted on the recessed sections of the grip, whereby a user's hand can more snugly hold the grip structure with a more comfortable touching feeling.

2. Tableware grip structure with comfortable touch feeling as claimed in claim 1, wherein the outer circumferences of the bulge sections and the fitting body fitted around the recessed sections together form a waved face for a user's hand to tightly hold and easily turn the grip structure, for a handicapped user.

3. Tableware grip structure with comfortable touch feeling as claimed in claim 1, wherein a through hole is formed on each of the upper and lower sides of each recessed section of the grip.

4. Tableware grip structure with comfortable touch feeling as claimed in claim 1, wherein a rear end of the grip is formed with an opening, the material of the fitting body being filled into the grip from the opening.

5. Tableware grip structure with comfortable touch feeling as claimed in claim 1, wherein the fitting body is made of rubber plastic with soft touching feeling.

6. Tableware grip structure with comfortable touch feeling as claimed in claim 1, wherein the fitting body and the grip have different colors.

7. Tableware grip structure with comfortable touch feeling as claimed in claim 1, wherein the fitting body and the grip have same colors.

* * * * *